US010427401B2

(12) United States Patent
Garcia Alvarez et al.

(10) Patent No.: US 10,427,401 B2
(45) Date of Patent: Oct. 1, 2019

(54) PRINTHEAD RECOVERY

(71) Applicants: Hewlett-Packard Development Company, L.P., Houston, TX (US); Ana Cristina Garcia Alvarez, Sant Cugat del Valles (ES); Yit Hong Tor, San Diego, CA (US)

(72) Inventors: Ana Cristina Garcia Alvarez, Sant Cugat del Valles (ES); Yit Hong Tor, San Diego, CA (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/749,450

(22) PCT Filed: Oct. 23, 2015

(86) PCT No.: PCT/EP2015/074671
§ 371 (c)(1),
(2) Date: Jan. 31, 2018

(87) PCT Pub. No.: WO2017/067614
PCT Pub. Date: Apr. 27, 2017

(65) Prior Publication Data

US 2018/0222183 A1 Aug. 9, 2018

(51) Int. Cl.
*B41J 2/045* (2006.01)
*B41J 2/165* (2006.01)

(52) U.S. Cl.
CPC ..... *B41J 2/04563* (2013.01); *B41J 2/0454* (2013.01); *B41J 2/0458* (2013.01); (Continued)

(58) Field of Classification Search
CPC ..... B41J 2/04563; B41J 2/04528; B41J 2/16535; B41J 2/0454; B41J 2/04588; B41J 2/16526
See application file for complete search history.

(56) References Cited

U.S. PATENT DOCUMENTS 5,894,314 A 4/1999 Tajika
5,980,034 A 11/1999 Tsai et al.
(Continued)

FOREIGN PATENT DOCUMENTS

CN 1027147 C 12/1994
JP 09155257 6/1997

OTHER PUBLICATIONS

Hong, Z. et al., "Directional Self-cleaning Surface Design for Ink Jetting Devices", Jan. 1, 2010, 1 page. http://www.ingentaconnect.com/content/ist/nipdf/2010/00002010/00000001/art00048.
(Continued)

*Primary Examiner* — Sharon A. Polk
(74) *Attorney, Agent, or Firm* — HP Inc. Patent Department

(57) ABSTRACT

A printing apparatus includes a printhead having a nozzle to eject liquid and an actuator associated with the nozzle. A controller is provided to activate a recovery sequence including heating the printhead without firing drops in a first phase, activating the actuator to fire 1000 drops or more from the nozzle in a second phase after the first phase, and heating the printhead and applying pressure to expel liquid from the nozzle in a third phase after the second phase.

19 Claims, 3 Drawing Sheets

(52) U.S. Cl.
CPC ..... *B41J 2/04528* (2013.01); *B41J 2/04588* (2013.01); *B41J 2/16526* (2013.01); *B41J 2/16535* (2013.01)

(56) References Cited

U.S. PATENT DOCUMENTS

| | | | | |
|---|---|---|---|---|
| 6,027,206 | A | 2/2000 | Bern et al. | |
| 6,305,776 | B1 | 10/2001 | Ohshima | |
| 6,460,972 | B1 | 10/2002 | Trauernicht | |
| 7,604,321 | B2 * | 10/2009 | Sheahan | B41J 2/0451 347/15 |
| 7,762,656 | B2 | 7/2010 | Snyder | |
| 8,220,896 | B2 | 7/2012 | Nystrom et al. | |
| 8,562,117 | B2 | 10/2013 | Limb | |
| 2002/0085061 | A1 * | 7/2002 | Kato | B41J 2/16526 347/30 |
| 2003/0169307 | A1 * | 9/2003 | Madziarz | B41J 2/03 347/12 |
| 2008/0316247 | A1 | 12/2008 | Cellura | |
| 2009/0015618 | A1 | 1/2009 | Jung | |

OTHER PUBLICATIONS

The International Searching Authority, "The International Search Report and the Written Opinion, Application No. PCT/EP2015/074671", dated Jun. 30, 2016, 12 pages.

* cited by examiner

PRINTHEAD RECOVERY

CLAIM FOR PRIORITY

The present application is a national stage filing under 35 U.S.C. § 371 of PCT application number PCT/EP2015/074671, having an international filing date of Oct. 23, 2015, the disclosure of which is hereby incorporated by reference in its entirety.

BACKGROUND

Printing apparatuses form printed images by ejecting liquid from nozzles of a printhead. Thereby, liquid is applied onto a print medium for printing a pattern of individual dots at particular locations. Some printing apparatuses use inks. Some printing apparatuses use latex inks. Some latex inks may include low percentages of wax content. Some printing apparatus use liquids different from ink such as in 3D printing, e.g. fluid on powder, digital titration, and other forms of high precision digital fluid dispensing.

BRIEF DESCRIPTION OF THE DRAWINGS

Examples will now be described, by way of non-limiting examples, with reference to the accompanying drawings, in which.

The examples and description below make reference generally to liquid jet printers, such as ink jet printers. Some ink jet printers use solvent inks and ultraviolet inks, which include hazardous components and give off unpleasant odor, which may result in discomfort and even health disorders. Some ink jet printers use so-called eco solvent inks including eco solvents which are biodegradable. Some ink jet printers use latex ink formulations. Latex inks as this term is used herein may include a liquid ink vehicle, latex polymer and pigment particles. Generally, the liquid ink vehicle may be water based. Latex inks are generally odor-free and do not include hazardous components. Examples herein relate to latex ink printing apparatuses.

Latex inks may include a low percentage of wax content. First generations of latex inks incorporated a wax content of about 1%. Adding wax to the latex ink may improve interaction between the ink and the medium and fixing the ink on the medium. Thus, durability and scratch resistance of printouts using latex inks may be improved. Therefore, detaching of a layer of ink laid on a medium and damages of the layer of ink may be avoided when the printed medium is handled or processed after printing, such as in cutting, perforating for fixing, placing the medium in a frame or folding the medium for transportation. Increasing the wax content may increase the improvement in durability. Thus, recently the wax content was increased to about 1.5% or even higher such as a content less than 2% or a wax content less than 5%.

Figure 1:
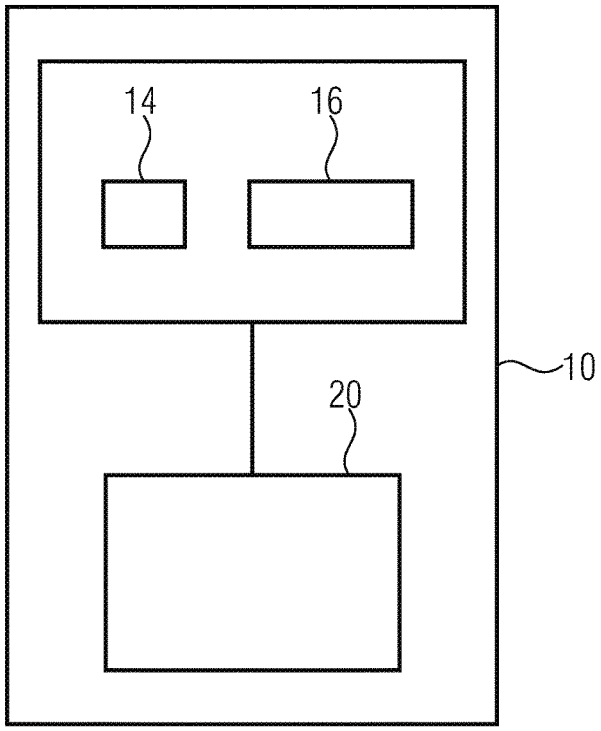
FIG. 1 is a block diagram of a printing apparatus according to one example.

A block diagram of a printing apparatus 10 according to an example is shown in FIG. 1. The printing apparatus comprises a printhead 12 including a nozzle 14 and an actuator 16 associated with nozzle 14. Drops of liquid can be ejected through nozzle 14 upon actuating actuator 16. Generally, printhead 12 will comprise an array of nozzles and associated actuators, while FIG. 1 shows a single nozzle and a single actuator only. The particular ejection mechanism within the printhead may take on a variety of different forms such as, but not limited to, those using thermal or piezoelectric printhead technology. In examples, the actuator is a resistor to heat liquid over the resistor. The printing apparatus further comprises a controller 20 coupled to the printhead 12. The controller is to control components of the printing apparatus 10 and the printhead 12, such as the actuator 16.

Controller 20 may be to provide the functionality described herein and to execute methods described herein. Controller 20 may be implemented, for example, by one or more discrete modules (or data processing components) that are not limited to any particular hardware and machine readable instructions configuration. Controller 20 may be implemented in any computing or data processing environment, including in digital electronic circuitry, e.g., an application-specific integrated circuit, such as a digital signal processor (DSP) or in computer hardware, device driver, or machine readable instructions. In some implementations, the functionalities are combined into a single data processing component. In other implementations, the respective functionalities may be performed by a respective set of multiple data processing components.

Figure 2:
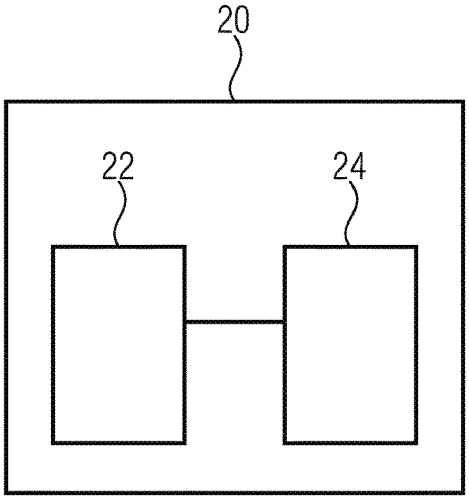
FIG. 2 is a block diagram of controller according to one example.

As shown in FIG. 2, controller 12 may comprise a processor 22 and a memory device 24 accessible by processor 22. Memory device 24 may store process instructions (machine-readable instructions, such as computer software) for implementing methods executed by controller 20. Memory device 24 may store instructions to control components of the printing apparatus to perform the recovery sequences described herein. Memory device 24 may include one or more tangible machine-readable storage media. Memory devices suitable for embodying these instructions and data include all forms of computer-readable memory, including, for example, semiconductor memory devices, such as EPROM, EEPROM, and flash memory devices, magnetic disks such as internal hard disks and removable hard disks, magneto-optical disks, and ROM/RAM devices. Routines and processes applied to the printhead to perform the recovery sequences described herein may be stored in memory device 24.

Figure 3:
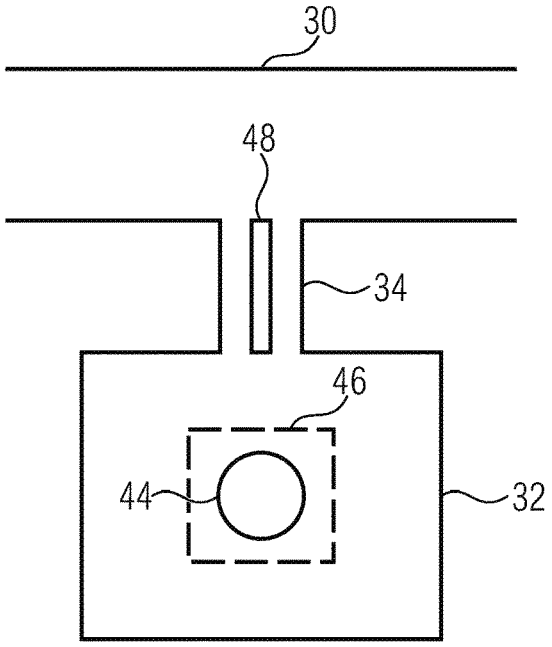
FIG. 3 is a schematic view of structures of an example of a printhead.

FIG. 3 is a schematic view of structures of an example of a printhead, which include a liquid supply channel 30, a firing chamber 32, and a connecting channel 34 coupling liquid supply channel 30 to firing chamber 32. A nozzle 44 is fluidically coupled to firing chamber 32. An actuator 46 is formed in the firing chamber. In examples, actuator 46 is formed by a resistor and is arranged in alignment with nozzle 44. Actuator 46 may be formed by a thin film resistor. One or more pillars 48 may be formed in connecting channel 34 to prevent solid contaminants from reaching firing chamber 32. Generally, a plurality of firing chambers may be connected to the liquid supply channel 30 via respective connecting channels. Put differently, the liquid supply channel may be common to a plurality of nozzles.

In operation, liquid, such as ink, is supplied to firing chamber via liquid supply channel 30 and connecting channel 34. In order to eject a liquid drop from nozzle 44, i.e. to fire nozzle 44, charge is briefly and quickly applied to actuator 46 formed by a resistor. Thus, liquid over the resistor in the firing chamber 32 is rapidly heated and boiled. Bubble formation occurs and drives a drop of liquid out of nozzle 44. The bubble then collapses, the drop of liquid breaks free from nozzle 44, a liquid meniscus within nozzle 44 settles and firing chamber 32 refills. Thereupon, the next drop may be fired.

It was found that printers using liquids including wax content may face image quality issues. Investigations revealed that the cause may be wax agglomerates formed of wax conglomerated together with pigments during printing and print head recovery routines. The agglomerates may reach the fluid channels placed at the entrance of the firing chambers, such as connecting channel 34 comprising pillar 48. Such agglomerates may block or partially block the liquid flow towards the nozzle. The result may be nozzles that fire without liquid inside the firing chamber (dry firing), eject drops with reduced drop size, eject drops with incorrect directionality resulting in significant misdirects, or eject drops with reduced speed resulting in misplaced drops on the medium. One or more of these effects may result in print quality issues. It was further found that temperature changes that the liquid undergoes within the printhead during processes, such as drop firing for detection and regular recovery routines, may promote the generation of the agglomerates. Increasing the amount of wax in the latex may promote agglomerates adhering to the printhead since improving the fixing properties of the liquid on the print medium may imply that the liquid also adheres to the printhead more tightly.

Print media may include plain print media, such as paper, uncoated polyester fabrics, polyester films, vinyl banners, polyethylene media, PET media, or polyester fabrics. Print media may include any rigid media, such as wood, tiles, polypropylene and acrylic. The print media may be pretreated or coated materials.

Examples described herein are directed to apparatuses and methods to eject liquid. The liquid may include wax. In examples, the liquid is ink, such as latex ink. Other examples described herein may be directed to apparatuses and methods to eject liquids other than ink, such as liquid materials used in 3D printing, such as thermoplastic materials, photopolymers, or fluid on powder. Other examples may be directed to apparatuses and methods to eject liquids used in digital titration and other forms of high precision digital fluid dispensing.

Examples of printing apparatuses and methods described herein may either prevent the formation of agglomerates or may dissolve and eliminate existing agglomerates by performing a recovery sequence. Thus, good liquid flow into the firing chamber and drops meeting the specification in terms of size, directionality and speed may be achieved, resulting in good image quality.

Examples provide a printing apparatus comprising a printhead and a controller. The printhead includes a nozzle to eject liquid and an actuator associated with the nozzle. The controller is to activate a recovery sequence including heating the printhead without firing drops in a first phase, heating the printhead and activating the actuator to fire 1000 drops or more from the nozzle in a second phase after the first phase, and heating the printhead and applying pressure to expel liquid from the nozzle in a third phase after the second phase.

Figure 4:
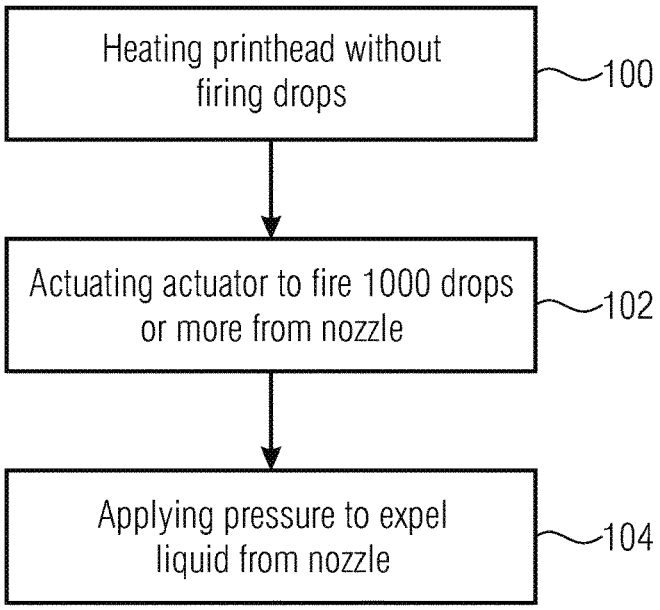
FIG. 4 is a flow diagram of a method to perform a recovery sequence according to one example.

Examples provide a method to perform a recovery sequence in a printhead including a nozzle to eject liquid and an actuator associated with the nozzle. As shown in FIG. 4, the method comprises heating 100 the printhead without firing drops in a first phase, heating the printhead and activating 102 the actuator to fire 1000 drops or more from the nozzle in a second phase after the first phase, and heating the printhead and applying pressure 104 to expel liquid from the nozzle in a third phase after the second phase.

Examples provide a non-transitory machine-readable storage medium encoded with instructions executable by a processing resource of a computing device to perform such a recovery sequence.

It was found that heating the printhead and firing many drops in a second phase after heating the printhead without firing drops in a first phase and, thereupon, heating and expelling liquid from the nozzle in a third phase after the second phase, may dissolve and remove agglomerates formed of wax and pigments. It was found that heating in the first phase may soften agglomerates and firing 1000 drops or more upon heating may cause liquid and agglomerates to move towards the firing chambers. Expulsion of this mass (liquid and agglomerates) though the nozzle may then be effected by applying pressure in the third phase. The volume of liquid continuously expelled in the third phase is much higher than the volume ejected when firing the nozzle. Pressure may be applied by applying positive pressure to liquid supply channel 30 or by applying negative pressure to nozzle 44. Pressure may be applied by a device separate from actuator 46. Thus, agglomerates may be removed and nozzle health and print head reliability may be restored.

In examples, heating the printhead in the first phase includes heating the printhead to a temperature higher than a regular printing printhead temperature. The regular printing printhead temperature is the printhead temperature which the printhead is heated to during regular printing, i.e. printing to generate printed media. In examples, the regular printing printhead temperature may be about 45° C. In examples, heating the printhead in the first phase includes heating the printhead to a temperature in a range from 60° C. and 70° C. for a period in a range from 45 s to 75 s. In examples, heating the printhead in the first phase includes heating the printhead to about 65° C. for a period of about 60 s.

In examples, the recovery sequence includes wiping a nozzle plate in which the nozzle is formed one time or several times in the first phase. In examples, the nozzle plate is wiped periodically in the first phase. The controller may be to control a web provided in the printer apparatus to clean the printhead for wiping the nozzle plate in the first phase. Thus, liquid and agglomerates adhering to the nozzle plate may be removed.

In examples, heating the printhead in the second phase while firing the drops includes heating the printhead to a temperature higher than a regular printing printhead temperature. In examples, heating the printhead in the second phase while firing the drops includes heating the printhead to a temperature in a range from 60° C. and 70° C. In examples, heating the printhead in the second phase while firing the drops includes heating the printhead to about 65° C. In examples, the recovery sequence includes activating the actuator to fire 10000 drops or more from the nozzle in the second phase. In examples, the recovery sequence includes activating the actuator to fire about 17000 drops from the nozzle in the second phase. In examples, the recovery sequence includes controlling the temperature of the printhead to a first temperature in the first phase, to a second temperature higher than the first temperature in a period prior to activating the actuator to fire the drops in the second phase and to a third temperature lower than the second temperature while activating the actuator to fire the drops from the nozzle in the second phase. In examples, the first and the third temperature may be in a range from 60° C. and 70° C. In examples, the first and the third temperature may be the same. In examples, the first and third temperature may be about 65° C. In examples, the second temperature may be about 80° C.

In examples, the recovery sequence includes activating the actuator to fire the drops in the second phase in several cycles and controlling the temperature of the printhead to the second temperature in a period between successive cycles. In examples, the same number of drops may be fired in each cycle. In examples, the recovery process includes activating the actuator to fire 500 drops or more in each cycle of a number of 10 cycles or more.

In examples, the recovery sequence includes activating the actuator to fire the drops in the second phase at one or both of a frequency higher than a regular recovery frequency and a temperature higher than a regular printing printhead temperature. In examples, the recovery sequence includes activating the actuator to fire the drops in the second phase at a frequency in a range from 15 kHz to 21 kHz. In examples, the regular recovery frequency may be about 6 kHz and the frequency higher than the regular recovery frequency may be about 18 kHz. In examples, the recovery sequence includes activating the actuator to fire the drops in the second phase at a temperature in a range from 60° C. and 70° C. In examples, the recovery sequence includes activating the actuator to fire the drops in the second phase at a temperature of about 65° C.

In examples, the recovery sequence further includes controlling the temperature of the printhead to a temperature higher than a regular printing temperature in the third phase. This temperature may be in a range from 60° C. to 70° C. In examples, this temperature is about 65° C. In examples, the recovery sequence includes applying a pressure in a range from 170 mBar to 230 mBar in the third phase. In examples, the recovery sequence includes applying a pressure of about 200 mBar in the third phase. In examples, the recovery sequence includes applying the pressure in the third phase for a period in a range from 60 s to 180 s. This period may be about 120 s.

In examples, controller 20 is to activate the recovery sequence. A warming device may be is used to control the temperature of the printhead. Such warming device may generally be employed to heat the printhead to a specific temperature during regular printing, such as 45° C., to minimize the effect of temperature variance from the beginning of printing to another point in the printing process. One or more temperature sensors may be provided to support control of the printhead's temperature. Controller 20 may be to control such warming device to heat the printhead as described herein. The warming device may be a separate warming device or may be formed by the firing resistors of a thermal fluid ejection device, such as a thermal inkjet printer. Controller 20 may be to control the electrical current to the firing resistors associated with a plurality of nozzles so that their temperature is below the threshold to be exceeded to eject a liquid drop. Thus, the printhead may be warmed to the desired temperature without firing the nozzles. This process is sometimes called "trickle warming" because the controller allows a trickle of energy to flow through the firing resistors. In this manner, the printhead temperature may be controlled until the desired temperature is reached.

In examples, priming is performed in the third phase by applying pressure to the liquid in the firing chamber and the liquid channels. During priming, liquid refill of the printhead may be forced by applying high pressure to the liquid to facilitate the expulsion of a big liquid volume and at the same time any particle that may be trapped. Pressure may be applied by means of a pressurizer, which may be hardware external to the printhead (in contrast to the actuators, which are internal to the printhead). Such a pressurizer is sometimes called primer. The pressurizer may be part of the printer and may be to apply positive pressure to the liquid present within fluidic structures of the printhead, such as the firing chambers and liquid channels. In examples, the pressurizer may be to blow air into a plastic bag placed inside a pen body of a cartridge including the printhead to reduce the space available for the liquid. Thus, liquid is driven out of the nozzles in bigger continuous quantities when compared to the single drops ejected when firing the nozzles by actuating the actuator. In other examples, the primer may be to apply a negative pressure to the liquid via the nozzles. Such a primer may be part of a capping station in which the printhead is placed, wherein the primer sucks the liquid from the nozzles.

The printer apparatus may include a maintenance station, in which the printhead may be located during the recovery sequence. The maintenance station may include a spittoon, into which liquid is ejected and expelled during the recovery sequence.

In examples, the controller is to activate the recovery sequence every time a printhead (such as a new printhead from the shelf) has been inserted into the printing device before regular printing starts. In examples, the controller is to activate the recovery sequence after idle times exceeding a predetermined period, such as every time the printing device was not used for printing a predetermined period of time, such as two or three weeks.

In examples, the printer apparatus may be a latex ink printer apparatus which is to eject latex ink from the nozzle or nozzles of a printhead. In examples, the printer apparatus may be to eject latex inks having a wax content of about 1%, of about 1.5% or even higher such as a was content less than 2% or a wax content less than 5%. The controller may be to control the actuator or actuators to eject drops of such inks having a drop size within a desired specification during regular printing operations. The controller may be to control the temperature of the printhead to about 45° C. during regular printing operations. Generally, in latex printers, the controller may be to activate regular recovery processes in which a regular recovery frequence of firing the nozzle or nozzles is about 6 kHz and in which priming is performed without applying temperature at a regular pressure of about 150 mBar. In examples, such regular recovery processes may be replaced by a recovery sequence described herein.

A specific recovery sequence according to an example is now described. The specific recovery sequence includes, in the first phase, heating the printhead to a temperature of 65° C. during 60 s without firing drops. In the first phase, the specific recovery sequence includes wiping the nozzle plate every 15 s, such as after 0 s, 15 s, 30 s and 45 s. Thereupon, the specific recovery sequence includes increasing the printhead temperature to 80° C. in the beginning of the second phase. Thereupon, the specific recovery sequence includes 17 cycles of firing, wherein, in each of the cycles, 1000 drops are fired from the nozzle. Thus, 17000 drops are fired from the nozzle in total. In the second phase, firing takes place at a printhead temperature of 65° C. and at a frequency of 18 kHz. Between successive cycles the printhead temperature is raised to 80° C. for a predetermined period, such as 0.5 s, in order to pre-heat the liquid prior to firing. The specific recovery sequence includes heating the printhead to 65° C. for 120 s in the third phase while applying a pressure of 199 mBar.

Figure 5:
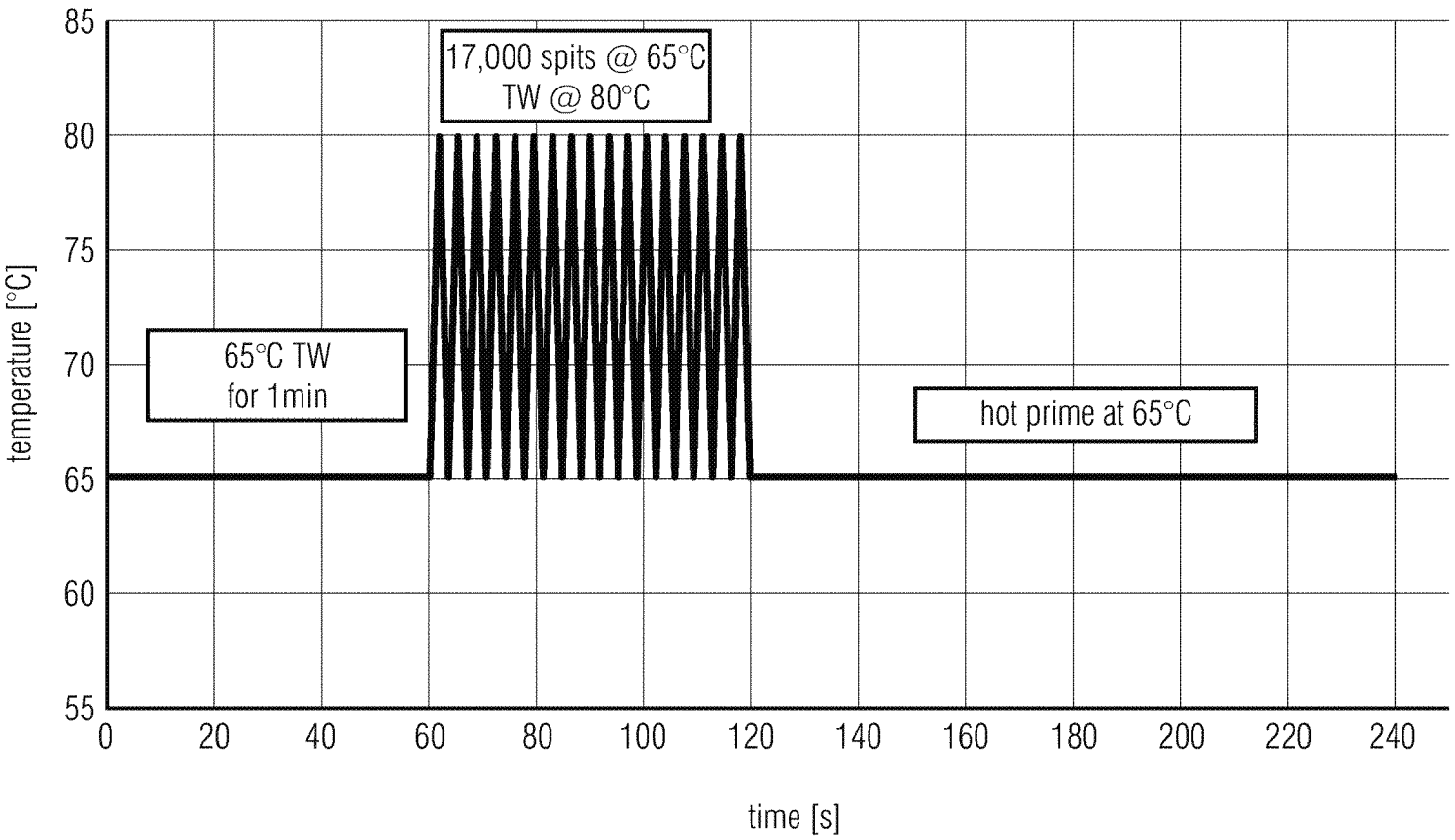
FIG. 5 is a diagram showing a temperature profile of a printhead when performing a method according to one example.

FIG. 5 shows the temperature profile of the printhead during the specific recovery sequence. In the first phase, the printhead temperature is controlled to 65° C., during the second phase the printhead temperature changes between 65° C. and 80° C., and in the third phase, the printhead temperature is controlled to 65° C.

The specific recovery sequence described above was found using experiments playing with different variables, such as heating temperature, firing frequency for drop firing, number of drops, priming pressure, and wiping the nozzle plate.

In examples, the printing apparatus may include a number of printheads, such as one printhead for each of different colors. Each printhead may include an array of nozzles. The controller may be to activate the recover sequence for each of the printheads separately.

Examples described herein may be helpful in preventing the formation of agglomerates or in dissolving and eliminating existing agglomerates. Thus, nozzle health and printhead reliability may be recovered. Printheads may be recovered very effectively and the drops during regular printing may be fired with correct size, directionality and speed. In examples, wax may be used as an liquid component and the wax amount in the liquid may be increased. Thus, printed images with high durability and scratch resistance properties may be achieved using odor-free and nonhazardous inks.

The term "about" as used herein is meant to include deviations of ±5% of the respective value which the term "about" refers to.

Examples relate to a non-transitory machine-readable storage medium encoded with instructions executable by a processing resource of a computing device to perform methods described herein.

Examples described herein can be realized in the form of hardware, machine readable instructions or a combination of hardware and machine readable instructions. Any such machine readable instructions may be stored in the form of volatile or non-volatile storage such as, for example, a storage device like a ROM, whether erasable or rewriteable or not, or in the form of memory such as, for example, RAM, memory chips, device or integrated circuits or an optically or magnetically readable medium such as, for example, a CD, DVD, magnetic disk or magnetic tape. The storage devices and storage media are examples of machine-readable storage that are suitable for storing a program or programs that, when executed, implement examples described herein.

All of the features disclosed in the specification (including any accompanying claims, abstract and drawings), and/or all the features of any method or progress disclosed may be combined in any combination (including any claim combination), except combinations where at least some of such features are mutually exclusive. In addition, features disclosed in connection with a system may, at the same time, present features of a corresponding method, and vice versa.

Each feature disclosed in the specification (including any accompanying claims, abstract and drawings) may be replaced by alternative features serving the same, equivalent or similar purpose, unless expressly stated otherwise. Thus, unless expressly stated otherwise, each feature disclosed is one example of a generic series of equivalent or similar features.

The foregoing has described the principles, examples and modes of operation. However, the teaching herein should not be construed as being limited to the particular examples described. The above-described examples should be regarded as illustrative rather than restrictive, and it should be appreciated that variations may be made in those examples by workers skilled in the art without departing from the scope of the present invention as defined by the following claims.

The invention claimed is:

1. A printing apparatus comprising:

a printhead including a nozzle to eject liquid and an actuator associated with the nozzle; and a controller to activate a recovery sequence including heating the printhead without firing drops in a first phase, heating the printhead and activating the actuator to fire 1000 drops or more from the nozzle in a second phase after the first phase, and heating the printhead and applying pressure to expel liquid from the nozzle in a third phase after the second phase, wherein the recovery sequence includes controlling a temperature of the printhead to a first temperature in the first phase, to a second temperature higher than the first temperature in a period prior to activating the actuator to fire the drops in the second phase, and to a third temperature lower than the second temperature while activating the actuator to fire the drops from the nozzle in the second phase.

2. The printing apparatus of claim 1, wherein the recovery sequence includes heating the printhead to a temperature higher than a regular printing printhead temperature in one or more of the first phase, the second phase, and the third phase.

3. The printing apparatus of claim 1, wherein heating the printhead in the first phase includes heating the printhead to the first temperature in a range from 60° C. and 70° C. for a period in a range from 45 s to 75 s.

4. The printing apparatus of claim 1, wherein the recovery sequence includes wiping a nozzle plate in which the nozzle is formed one time or several times in the first phase.

5. The printing apparatus of claim 1, wherein the recovery sequence includes activating the actuator to fire 10000 drops or more from the nozzle in the second phase.

6. The printing apparatus of claim 1, wherein the recovery sequence includes activating the actuator to fire the drops in the second phase in several cycles and controlling the temperature of the printhead to the second temperature in a period between successive cycles.

7. The printing apparatus of claim 6, wherein the recovery sequence includes activating the actuator to fire 500 drops or more in each cycle of a number of 10 cycles or more.

8. The printing apparatus of claim 1, wherein the recovery sequence includes activating the actuator to fire the drops in the second phase at one or both of a frequency higher than a regular recovery frequency and a temperature higher than a regular printing printhead temperature.

9. The printing apparatus of claim 8, wherein the recovery sequence includes activating the actuator to fire the drops in the second phase at one or both of a frequency in a range from 15 kHz to 21 kHz and a temperature in a range from 60° C. to 70° C.

10. The printing apparatus of claim 1, wherein the recovery sequence further includes controlling the temperature of the printhead to a temperature higher than a regular printing temperature in the third phase.

11. The printing apparatus of claim 1, wherein the recovery sequence includes applying the pressure in a range from 170 mBar to 230 mBar in the third phase.

12. The printing apparatus of claim 1, wherein the recovery sequence includes applying the pressure in the third phase for a period in a range from 60 s to 180 s.

13. A method to perform a recovery sequence in a printhead including a nozzle to eject liquid and an actuator associated with the nozzle, the method comprising:

heating the printhead without firing drops in a first phase;

heating the printhead and activating the actuator to fire 10,000 drops or more from the nozzle in a second phase after the first phase; and heating the printhead and applying pressure to expel liquid from the nozzle in a third phase after the second phase.

14. A non-transitory machine-readable storage medium encoded with instructions executable by a processing resource of a computing device to perform a recovery sequence in a printhead including a nozzle to eject liquid and an actuator associated with the nozzle, the instructions upon execution causing the processing resource to:

control heating of the printhead without firing drops in a first phase;

control heating of the printhead and activating the actuator to fire 1000 drops or more from the nozzle in a second phase after the first phase at one or both of a frequency higher than a regular recovery frequency and a temperature higher than a regular printing printhead temperature; and control heating of the printhead and applying of pressure to expel liquid from the nozzle in a third phase after the second phase.

15. The non-transitory machine-readable storage medium of claim 14, wherein the recovery sequence is a first recovery sequence, and the regular recovery frequency is a frequency used in a second recovery sequence different from the first recovery sequence, and wherein the regular printing printhead temperature is a printhead temperature at which the printhead is heated during printing to generate printed media.

16. The non-transitory machine-readable storage medium of claim 14, wherein the recovery sequence includes controlling the temperature of the printhead to a first temperature in the first phase, to a second temperature higher than the first temperature in a period prior to activating the actuator to fire the drops in the second phase, and to a third temperature lower than second temperature while activating the actuator to fire the drops from the nozzle in the second phase.

17. The non-transitory machine-readable storage medium of claim 14, wherein heating the printhead in the first phase includes heating the printhead to a temperature in a range from 60° C. and 70° C. for a period in a range from 45 s to 75 s.

18. The non-transitory machine-readable storage medium of claim 14, wherein the recovery sequence includes controlling the applying of the pressure in a range from 170 mBar to 230 mBar in the third phase.

19. The non-transitory machine-readable storage medium of claim 14, wherein the recovery sequence includes controlling the applying the pressure in the third phase for a period in a range from 60 s to 180 s.

* * * * *